United States Patent [19]

Fujii et al.

[11] 4,042,093

[45] Aug. 16, 1977

[54] TEXTILE SLIVER CAN CHANGING AND STORAGE APPARATUS

[75] Inventors: Masakatsu Fujii; Toshio Yasufuku, both of Ohgaki, Japan

[73] Assignee: Kabushikikaisha Hara Shokki Seisakusho, Japan

[21] Appl. No.: 703,544

[22] Filed: July 8, 1976

[30] Foreign Application Priority Data

July 17, 1975 Japan ..... 50-86703

[51] Int. Cl.[2] ..... B65G 25/10

[52] U.S. Cl. ..... 198/339; 198/742; 214/1 BB

[58] Field of Search ..... 198/339, 570, 741–746; 214/1 BB

[56] References Cited

U.S. PATENT DOCUMENTS 1,997,710 4/1935 Wolf ..... 198/745

3,435,943 4/1969 Johnson ..... 198/742

*Primary Examiner*—Evon C. Blunk
*Assistant Examiner*—Jeffrey V. Nase
*Attorney, Agent, or Firm*—Pierce, Scheffler & Parker

[57] ABSTRACT

Can changing apparatus for drawing frame having at least one series of a can filling station and one or more empty can ready stations spaced at regular intervals, doffing means reciprocably disposed along the series of the stations to intermittently produce one cycle of reciprocation and having a series of pivoted arms identical in number and identically spaced with the series of stations. The apparatus further comprises means to swing the series of arms all simultaneously upright on retracting stroke of the reciprocation motion while keeping in horizontally swung down position on advancing stroke to thereby advance succeeding cans on the stations all together one stroke ahead of their former locations toward and away from the can filling station.

4 Claims, 9 Drawing Figures

TEXTILE SLIVER CAN CHANGING AND STORAGE APPARATUS

BACKGROUND OF THE INVENTION

This invention relates to textile processing apparatus and more particularly to a type of the apparatus in which can storage and changing operation is performed by moving to and from a can filling station a succession of cans for filling with coiled sliver from a coiler such as is used at the delivery end of a textile sliver drawing frame or the like.

While various types of the textile processing apparatus have been provided for changing the full can to an empty can with or without stoppage of the sliver delivery rolls, none have proven to be entirely sufficient, particularly in simplifying structurally the apparatus and saving the substantial manufacturing costs.

SUMMARY OF THE INVENTION

A principal object of the invention is to provide an improved textile processing apparatus of simpler and accordingly cheaper structure.

It is another object of the invention to provide can changing apparatus of a type which is enabled to be readily operated and accessible by the operator during the sliver processing operation.

The foregoing object and others are attained according to at least one aspect of the present invention through the provision of at least one linearly arranged series of a can filling station and one or more empty can ready stations, and doffing means employed to intermittently perform one cycle or reciprocation along said linear series of stations for moving said succession of cans to and from the can filling station.

Thus, in the disclosed embodiments, there are comprised at least one series of a can filling station and one or more empty can ready stations spaced at regular intervals, doffing means reciprocably disposed along the series of the stations to intermittently produce one cycle of reciprocation and having a series of pivoted arms identical in number and identically spaced with the series of stations, means to swing the series of arms all simultaneously upright on retracting stroke of the reciprocation motion while keeping in horizontally swung down position on advancing stroke to thereby disengage from and engage the succeeding cans on the stations respectively in the retracting and advancing strokes, and electrical means to intermittently cause the doffing means to perform the said one cycle of reciprocation in which the periods of rest are evenly spaced and of equal length.

DESCRIPTION OF THE PREFERRED EMBODIMENT

Figure 1:
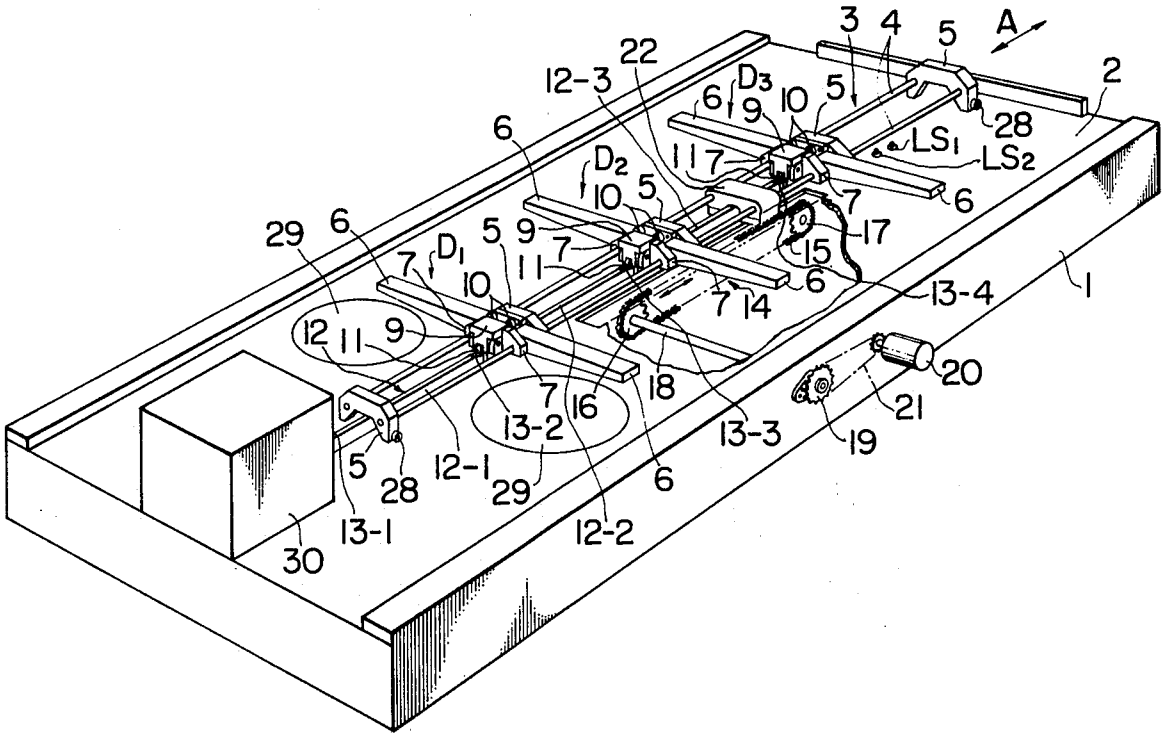
FIG. 1 is a perspective view of the preferred embodiment of the can changing apparatus of the invention.

In FIG. 1 is shown a perspective view of the apparatus of the invention wherein may be seen an entirety of the apparatus as well as major mechanical elements thereof. The apparatus has a base frame 1 of a shallow empty but closed cube form. On the upper wall 2 of the base frame 1 is mounted the major mechanical elements and beneath the wall 2 is equipped driving means as shown through the broken away portion of the wall 2. The major mechanical elements is generally indicated at 3 in FIG. 1 and referred to as "doffing means" hereinafter. The doffing means 3 forms the main parts of the apparatus and is intermittently given a reciprocating motion as shown by the double arrow A at the right in FIG. 1 for doffing two full cans (not shown in FIG. 1 but only one is shown in FIGS. 5A to 5D) on two turntables 29 driven by driving means to be described.

Figure 2:
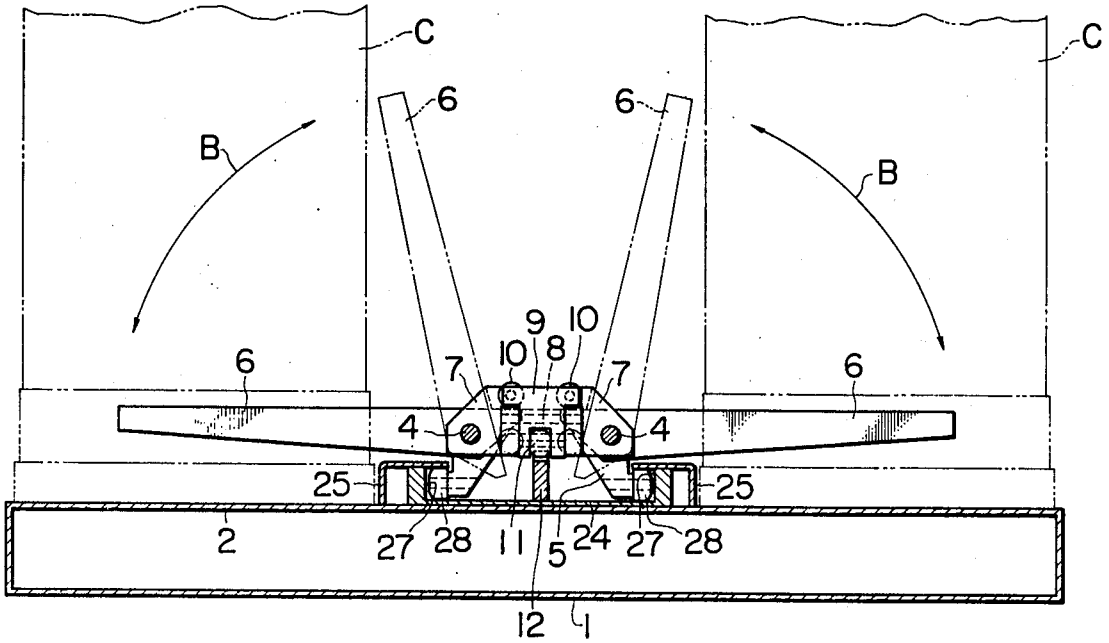
FIG. 2 is a side elevation, partly in section and partly broken away, of the apparatus of FIG. 1.

The doffing means 3 has a series of three doffing assemblies generally indicated by the reference characters D1 to D3. The assemblies D are located at regular intervals along a pair of parallel rods 4 extending throughout the entire length of the doffing means 3. The rods 4 are connected by a plurality of connecting members 5 also spaced each other at regular intervals so as to form a frame somewhat like a backborne of the doffing means 3. Each assembly D has a pair of doffing arms 6 free to swing on the rods 4 through an angle of about 90° as indicated in FIG. 2 by the arcuate double arrow B.

Figure 3:
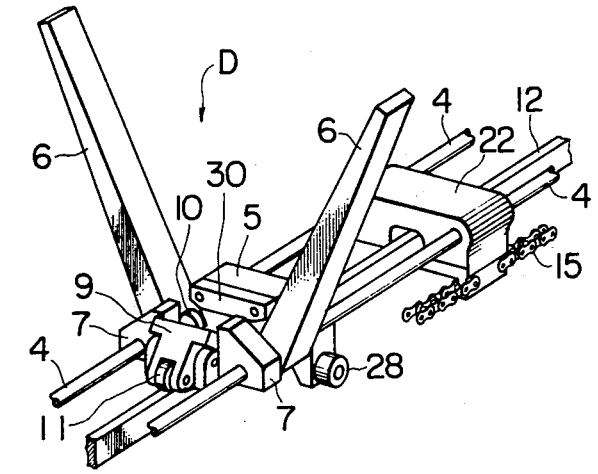
FIG. 3 is a perspective view partly broken away.
Figure 4:
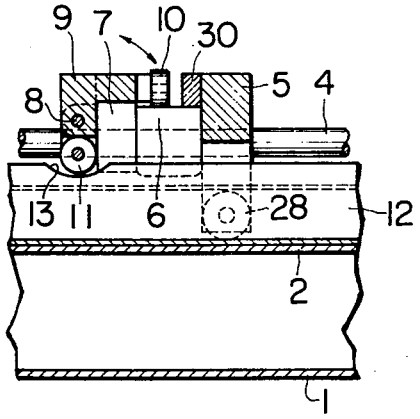
FIG. 4 is an elevational view partly broken away.

As shown in FIG. 3 in enlarged scale, each doffing arm assembly D has a pair of brackets 7 fast on the corresponding rods 4 respectively, with an interval relative to the member 5. Within the space between each connecting member 5 and the corresponding bracket 7 is movably or swingably located the foot portion of the doffing arm 6 as will be seen in FIG. 1. As shown in FIG. 4, each pair of brackets 7 carries transversely to the rods 4 a lateral shaft or pivot pin 8 on which is rotatably mounted a bellcrank lever 9. A vertical arm of the bellcrank lever 9 has at its extremity a roller or cam follower roller 11, and a horizontal forked arm of the bellcrank lever 9 has a pair of rollers 10 (only one of the rollers is seen in FIGS. 3 and 4) free to rotate on the corresponding forked arm end as best shown in FIG. 4. As will be seen in FIG. 4, the upper rollers 10 normally engage the foot portions of the doffing arms 6 except in case of forward doffing stroke of the doffing means 3 as detailed as the discussion proceeds. The roller 11 normally engages the cam means generally indicated in FIG. 1 by the numeral 12, and formed of a series of cam faces 12-1 to 12-3 at regular intervals 13-1 to 13-4.

The cam means 12 is fast on the upper face of the wall 2 whereas the doffing means 3 is free to reciprocate along the cam means 12, so that the doffing arms swing through an angle of about 90° as the doffing means 3 is given reciprocation.

The reciprocation of the doffing means 3 is given by driving means located within the base frame 1 as best shown in FIG. 1. The driving means generally shown at 14 includes an endless chain 15 which runs on a driving sprocket wheel 16 and driven sprocket wheel 17. The driving wheel 16 is driven through the shaft 18, sprocket 19, endless chain 21 by a electric driving motor 20, which intermittently rotates for a predetermined period immediately followed by a reverse rotation period of the same length in its one cycle of operation.

The endless chain 15 is operatively connected to the rods 4 through means of a connecting member 22 fast on the rods so that the doffing means 3 is intermittently reciprocated as the motor 20 intermittently produces one cycle of opposite rotations each for the same period.

As best shown in FIG. 2 in cross sectional view, the apparatus has a central U-shaped guide rail 24 and a pair of L-shaped guide rails 25 associated each other to form a pair of parallel guiding paths 27. Each connecting member 5 has at its both foot ends guiding rollers 28 which rotatingly suits the paths 27 so that the doffing means 3 is guided by the parallel paths 27 and prevented from being lifted up by a reactional force derived from engaging of the lower rollers 11 with the cam faces.

In FIG. 1, all the parts of the apparatus occupy their rest positions or are ready to start the doffing motion while the turn tables 29 are rotated for filling the cans C1 (in FIG. 5A) on the turntables 29 with the sliver from the coiler (not shown).

When the cans C1 are filled with a predetermined amount of sliver, the doffing means 3 starts the leftward movement or the doffing stroke with all the doffing arms 6 kept lowered horizontally to push the succeeding two series of cans. Each doffing arm 6 reaches the preceding or front position a predetermined distance or one stroke ahead of its former location. The full cans C1 are accordingly moved from the turntables 29 to the adjacent leftward marginal spaces on the base frame 1 to be removed from the base manually or by suitable conveying means (not shown). The other succeeding cans C are moved all together simultaneously to the left one stroke ahead of their former locations, so that a empty can is substituted for that filled can on each turntable 29.

Immediately after such removal of the filled cans is finished, the doffing means 3 starts the returning or retracting stroke to the right in FIG. 1. On the retracting stroke, all the arms 6 are kept upright owing to the cam action by cam means 12 and their associating bellcrank lever 9 which will be described in great detail hereinafter. Because of the upright disengaging position of the arms 6, all the cans C are left stationary even though the doffing means 3 is backward moved on the retracting stroke. At the reaward extremity end of the return stroke, all the rollers 11 meet the concave surfaces 13, namely disengage from the cam faces 12 and all the arms 6 accordingly restore their original positions shown in FIG. 1.

The swing motion of the arms 6 is somewhat metaphorically an oaring motion of a boat in which all the oars are submerged on their pulling stroke while rising upward on the retracting idling stroke.

The swing motion of all the arms 6 is hereinafter described in great detail with reference to FIGS. 5A to 5D. In these Figures, all the cans C are shown in fantom and partially broken away for illustration convenience. The leftwardmost arm assembly D1 is faced to the filling can C1 on the turntable 29 and is ready to doff thereof when filling is finished, while the second assembly D2 is faced to the second can C2 on the empty can ready station and is ready to push to the left thereof simultaneously with the doffing of the filling can C1. All the arms 6 are kept lowered in this position so that all the cans are together moved to the left one stroke of the reciprocation of the doffing means 3.

Figure 5A:
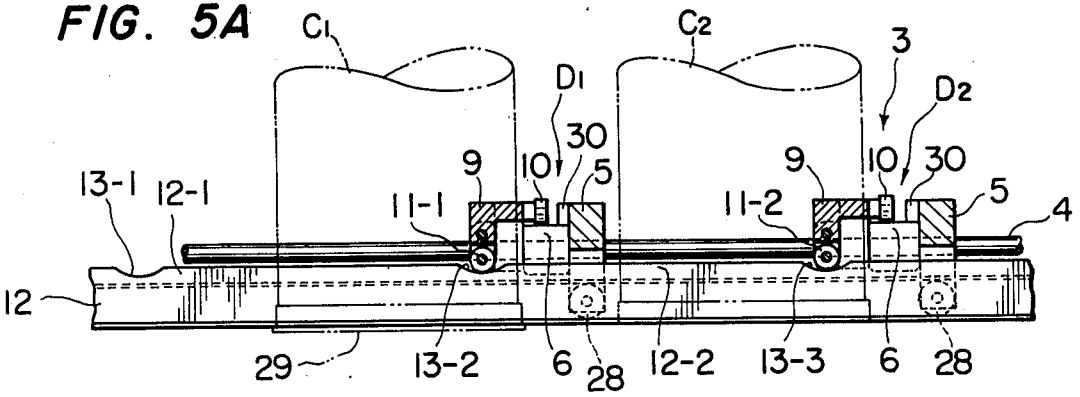
FIG. 5A to 5D are elevational views partly broken away and showing the various stages of operation of the apparatus; and, FIG. 6 is an electrical circuit diagram of the apparatus of FIG. 1.
Figure 5B:
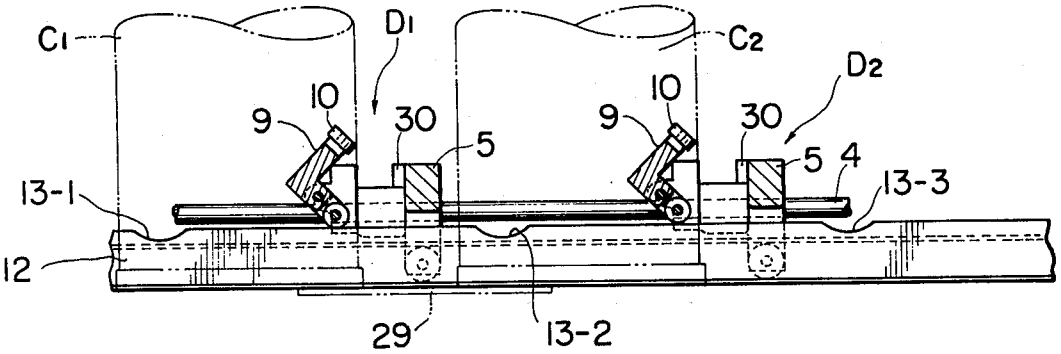

In FIG. 5B, each doffing arm assembly is midway between each pair of concave surfaces 13 of the cam means. It will be seen in FIG. 5B, that the bellcrank lever 9 of such doffing arm assembly D occupies a position a certain angular amount ahead of its former angular location in FIG. 5A. Such rotation or swing is caused by movement of the doffing means relative to the stationary cam means 12, due to the cam action of the cam means and its follower 9. The swinging movement of the lever 9 will be understood readily by tracing the arrangement of the cam and the lever. It should be noted that the swing is intended for the purpose of keeping the arms 6 horizontal on the forward doffing stroke. In order to ensure precisely such horizontal position, every connecting member 5 is provided with in its front side vertical face a projection 30 which serves as a stopper member against which every arm 6 is normally urged by the action of gravity as seen in FIGS. 1 and 5.

Figure 5C:
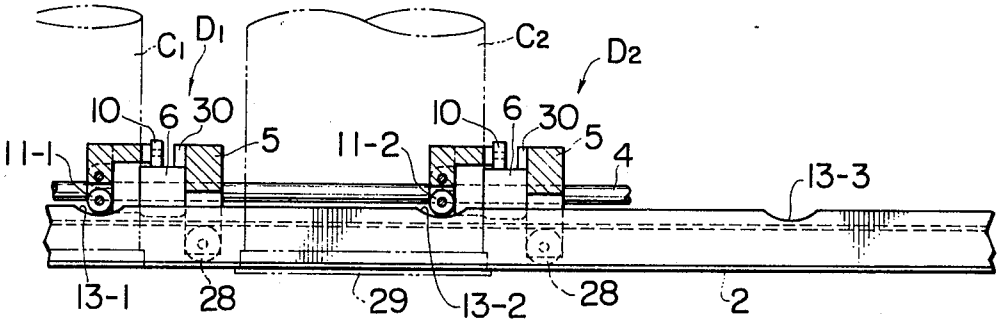

In FIG. 5C, the doffing means 3 is at the terminal end of the doffing stroke and the rollers 11-1 and 11-2 occupy the antecedent concaves 13-1 and 13-2 respectively one stroke ahead of their formerly occupied concave surfaces 13-2 and 13-3 shown in FIG. 5A. The levers 9 accordingly restore the original positions shown in FIG. 5A by the action of gravity. It will be seen in the view, that the filled can C1 is away from the turntables 29 formerly occupied thereby while the succeeding can C2 is on the turntable 29, thus substituting the empty can C2 for the full can C1 being achieved.

Figure 5D:
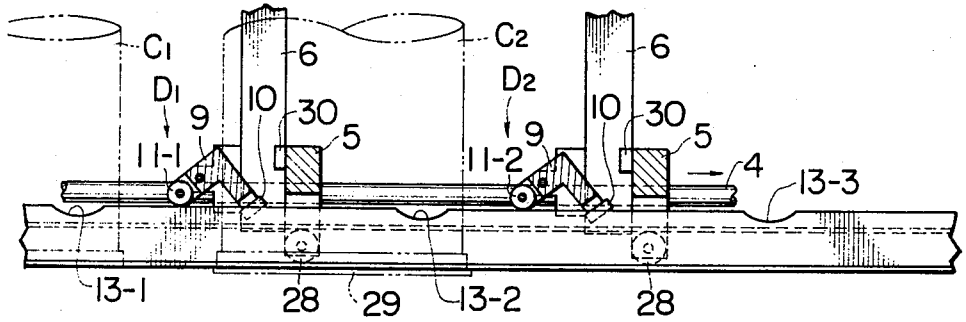

In FIG. 5D, is shown the stage at which the doffing means 3 is in the middle on returning stroke thereof so that rollers 11 are riding over the rising cam faces 12 with each bellcrank lever 9 reversely swung and thence with its rollers 10 urging the foot portion of each arm 6 to the lowermost position to thereby hold the arms 6 disengaged from the corresponding cans C.

As the doffing means 3 reaches the end of the returning stroke, each bellcrank lever 9 occupies the position shown in FIG. 5A and one cycle of the doffing motion is thus completed, while the new cans on the turntables 29 being in position to be filled with the sliver from the coiler.

In the foregoing, description has been made with reference to the embodiment in which two parallel series of the stations are provided and one doffing means is located therebetween in order that the succeeding cans on either side of the doffing means may be advanced by said single doffing means 3. However, modification may be made by those skilled in the art within the spirit of the invention and the scope of the appended claims.

Incidentally, it may be mentioned that the aforementioned function of the apparatus is principally based upon the remarkable bellcrank lever 9 and its associated parts which enable the lever 9 to swing from its rest position either in counter-clockwise direction or clockwise direction independency upon whether the doffing means is on the forward stroke or retracting stroke, respectively.

Figure 6:
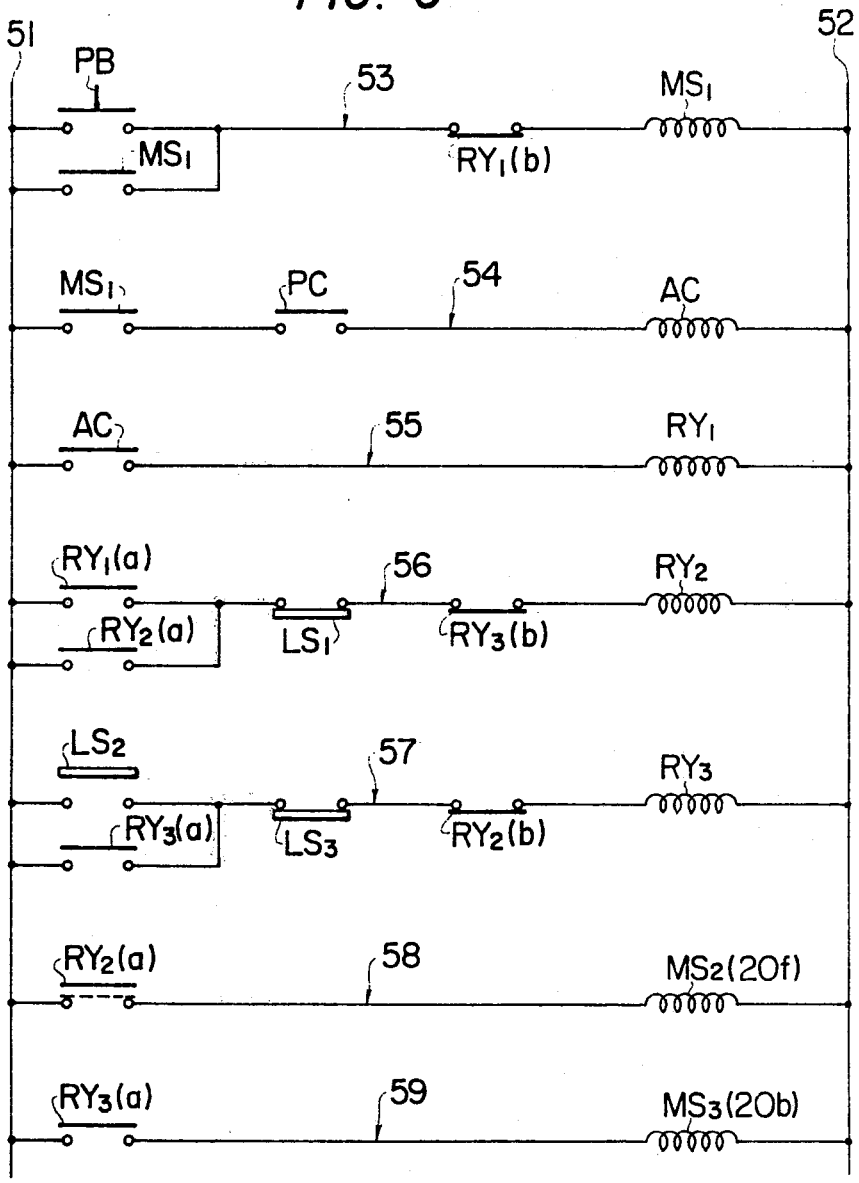

In FIG. 6, various electrical elements are shown, being connected to form various circuits 53 to 59 and in turn the entire circuit between two circuits lines 51 and 52. Although the electric system does not form the present invention, description is made hereinafter for convenience of understanding.

The circuit 53 is formed of push button switch contacts PB, normally closed relay switch contacts RY1(*b*) and a magnetic switch coil MS1. The push button switch contacts PB are provided with a parallel and normally opened magnetic switch contacts MS1 which are closed by magnetically energizing the coil MS1 in the same circuit 53. The parallel switch contacts MS1 are provision for self-locking the circuit in conductive or closed condition even though the push button switch contacts PB are opened.

The circuit 54 is formed of the same normally opened magnetic switch contacts MS1, pulse making counter contacts PC, and a coil of an automatic counter AC.

The circuit 55 is formed of switch contacts AC which is normally opened but closed in case of magnetic energization of coil AC in the circuit 54 and a relay coil RY1.

The counter PC is driven with the delivery rollers (not shown) of the drawing frame (not shown) to thereby produce a series of pulses as the delivery rollers rotates during the drawing operation.

The auto-counter AC is of well known type to those skilled in the art and need not be herein further described except as to their function of mechanically and momentarily closing a set of switch contacts AC in circuit 55 upon reaching a predetermined number of the pulses from the counter PC, namely upon reaching a predetermined yardage of sliver fed between a pair of rolls (not shown) of the delivery means of the drawing frame as determined by the number of revolution of said rollers.

The circuit 56 is formed of normally opened relay contacts RY1(*a*), normally closed limit switch contacts LS1, normally closed relay switch contacts RY3(*b*), and a relay coil RY2. The relay switch contacts RY1(*a*) are provided with, for self-locking purpose, normally opened relay switch contacts RY2(*a*) which is closed by magnetically energizing the coil RY2 in the same circuit 56.

The circuit 57 is formed of normally opened limit switch contacts LS2, normally closed limit switch contacts LS3, normally closed relay switch contacts RY2(*b*) the magnetic coil RY2 of which is in the other circuit 56, and relay coil RY3. The limit switch contacts LS2 are provided with, for self-locking purpose, parallel and normally opened relay switch contacts RY3(*a*) which are closed by magnetically energizing the coil RY3 in the same circuit 57.

The circuit 58 is formed of normally opened relay switch contacts RY2(*a*) which is closed by magnetically energizing coil RY2 in the circuit 56, and a magnetic switch coil MS2. The switch contacts of the magnetic switch MS2 are not shown in FIG. 6 and are in series with a forward terminal 20f of the doffing motor 20 to drive thereof in forwardly advancing the doffing means 3 on its doffing stroke.

The circuit 59 is formed of normally opened relay contacts RY3(*a*) which is closed by magnetically energizing relay coil RY3 in circuit 57, and a magnetic switch coil MS3. The magnetic switch contacts which are governed by the magnetic switch coil MS3 are not shown in FIG. 6 and are in series with a backward terminal 20b of the doffing motor 20 to reversely drive thereof on the retracting stroke of the doffing means 3.

In operation, when the push button PB is manually pushed, the circuit 53 momentarily becomes conductive and the coil MS1 is magnetically energized. The parallel switch contacts MS1 is closed by such magnetic force of the coil MS1 and is thereafter held in closed condition even though the push button PB is released. The energization of the coil MS1 also causes the switch contacts MS1 in the circuit 54 to close. In such closed condition of the contacts MS1, the main motor (not shown) is conductive to drive the drawing fram, drawing operation of the drawing frame being thus initiated.

The counter PC repeats closing and opening the contacts PC in the circuit 54 to thereby produce a series of pulses as the delivery roller of the drawing frame rotates. Upon reaching a predetermined number of such pulses as determined by the number of rotation of said rollers, namely by the predetermined yardage of the sliver fed through the delivery rollers, the coil AC in circuit 54 is magnetically energized to thereby close the contacts AC in the next circuit 55.

Upon such closing of the contacts AC, the relay coil RY1 in the circuit 55 is magnetically energized and in turn its contacts RY1(*a*) in circuit 56 is closed. Upon closing of the contacts RY1(*a*), the circuit 56 becomes conductive and coil RY2 is magnetically energized to close the switch contacts RY2(*a*) for self-locking circuit 56 in conductive condition.

Referring to circuit 58, the above mentioned closed condition of the contacts RY2(*a*) in the circuit 56 is also effective in circuit 58. The conductive condition of the circuit 58 energizes coil MS2 and in turn the forward terminal 20f of the doffing motor 20 is connected to the electric supply source. The doffing forward stroke of the doffing means 3 is thus initiated.

The forward movement of the doffing means 3 ceases upon opening of the limit switch contacts LS1 in the circuit 56 reached by the rightwardmost member 5 of the doffing means 3 (FIG. 1). The energized condition of the coil RY2 in circuit 56 ceases upon such opening of limit switch LS1. Such deenergization of coil RY2 causes the relay contacts RY2 in both circuits 56 and 58 to be together opened to thereby have both circuits become non-conductive. The motor 20 therefore stops and the doffing means 3 stops forward movement except an enertial movement of slight distance.

Immediately after reaching the limit switch LS1, the rightwardmost member 5 (FIG. 1) further reaches the subsequent limit switch LS2 located slightly leftwardly of the switch LS1 by the inertial energy stored within the doffing means 3 during its forward movement. The limit switch contacts LS2 in circuit 57 is closed thereby. The circuit 57 is hence closed and at the same time the coil RY3 in circuit 57 is energized to thereby close the contacts RY3(*a*) in circuit 57 for self-locking circuit 57 in closed condition. Such closing of relay contacts RY3(*a*) is also effective in circuit 59 to thereby energize magnetic switch coil MS3. The magnetic switch coil MS3 in turn closes switch contacts (not shown) which are in series with the reverse rotation terminal **20*b* of the doffing motor 20. The doffing means 3 accordingly initiates backward travel. At the terminal end of the reverse stroke of the doffing means, the rightwardmost member 5 reaches the third limit switch LS3 (not shown) which is located immediately behind that member 5 in FIG. 1 within the back stroke reach of the doffing means. The limit switch contacts LS3 in circuit 57** are accordingly opened and relay coil RY3 in the same circuit is deenergized. The relay contacts RY3(*a*) in circuits 57 and 59 are both opened and the driving motor 20 thus stops.

One cycle of the doffing operation is thus completed and the apparatus enters into rest period until subsequent cycle is initiated. The next or subsequent cycle may be initiated by pushing the push button PB as stated in the foregoing. In actual practice, there need be provision for automatic resetting which can be included if desired and illustration or description may be abbreviated accordingly in this specification.

It should be noted that the relay switch contacts RY1(*b*) in circuit 53 is opened when the other contacts RY1(*a*) is closed in circuit 56 by the known property of the relay arrangement. The magnetic switch coil MS1 is therefore deenergized and hence the contacts MS1 in circuit 53 is opened. The main motor stops to drive the drawing frame. From this, it will be understood that the doffing operation is performed under stopped condition of the drawing frame.

Within a box 30 shown at the left in FIG. 1 is equipped the electric parts shown in FIG. 6.

What is claimed is:

1. A can doffing apparatus having;

at least one series of a can filling station and one or more empty can ready stations spaced at regular intervals to sustain thereon respectively succeeding cans, doffing means reciprocably disposed along the series of the stations to intermittently produce one cycle of reciprocation and having a series of pivoted arms identical in number and identically spaced with the series of stations, means to swing the series of arms all simultaneously upright on retracting stroke of the reciprocation motion while keeping in horizontally swung down position on advancing stroke to thereby disengage from and engage the succeeding cans respectively on the retracting and advancing strokes, said means to swing the series of arms comprising linear cam extending along and fast to the series of stations and one cam follower member mounted on the doffing means for each arm to transmit the cam action from the cam to the corresponding arm, and electrical driving means to intermittently cause the doffing means to perform the said one cycle of reciprocation rest periods of which are evenly spaced and of equal length.

2. A can doffing apparatus as claimed in claim 1 wherein, said cam follower members are swung from their rest positions either in the counterclockwise direction or clockwise direction independency upon whether the doffing means is on the advancing or retracting stroke to thereby disconnect or connect the arms with the cam member and in turn to swing all the arms upright on the retracting stroke while keeping in horizontal swung down position on the advancing stroke.

3. A can doffing apparatus as claimed in claim 1 wherein, said series of stations further comprises a second empty can ready station in succession to the first empty can ready station.

4. A can doffing apparatus as claimed in claim 1 wherein, two parallel linear series of stations are provided and one doffing means is disposed between the two series of stations and has also two series of said swinging arms in one-for-each relation with the stations.

* * * * *